US005442383A

United States Patent [19]

Fuse

[11] Patent Number: 5,442,383

[45] Date of Patent: Aug. 15, 1995

[54] INK JET PRINTER WITH A DEVICE FOR DETERMINING A PRINTING INTERVAL

[75] Inventor: Takeshi Fuse, Kanagawa, Japan

[73] Assignee: Fuji Xerox Co., Ltd., Tokyo, Japan

[21] Appl. No.: 49,304

[22] Filed: Apr. 21, 1993

[30] Foreign Application Priority Data

Apr. 22, 1992 [JP] Japan ..... 4-102853

[51] Int. Cl.[6] ..... B41J 2/01; B41J 29/26

[52] U.S. Cl. ..... 347/19; 347/14

[58] Field of Search ..... 346/1.1, 75, 139 R, 346/140 R; 395/105; 400/322, 279, 703, 706; 347/5, 40, 41, 19, 14, 37

[56] References Cited

U.S. PATENT DOCUMENTS 4,515,487 5/1985 Minami ..... 400/121
5,250,956 10/1993 Haselby et al. ..... 346/1.1

FOREIGN PATENT DOCUMENTS 56-144170 11/1981 Japan .
57-138953 8/1982 Japan .
62-109657 5/1987 Japan .
63-15775 1/1988 Japan .
2-243373 9/1990 Japan .

*Primary Examiner*—Benjamin R. Fuller
*Assistant Examiner*—Alrick Bobb
*Attorney, Agent, or Firm*—Finnegan, Henderson, Farabow, Garrett & Dunner

[57] ABSTRACT

An ink jet printer according to the present invention provides a carriage adapted to move relative to a recording medium, a printing head mounted on the carriage in such a manner that the printing head is inclined by a predetermined angle with respect to a printing direction, a plurality of nozzles arranged in a line on the printing head, first device for jetting ink from the nozzles and printing in a direction of an arrangement of the nozzles by a length thereof by driving each of the nozzles at a predetermined time interval, second device for determining a printing interval between adjacent nozzles in accordance with a printing speed of the printing head and a mounting angle defined thereby.

8 Claims, 9 Drawing Sheets

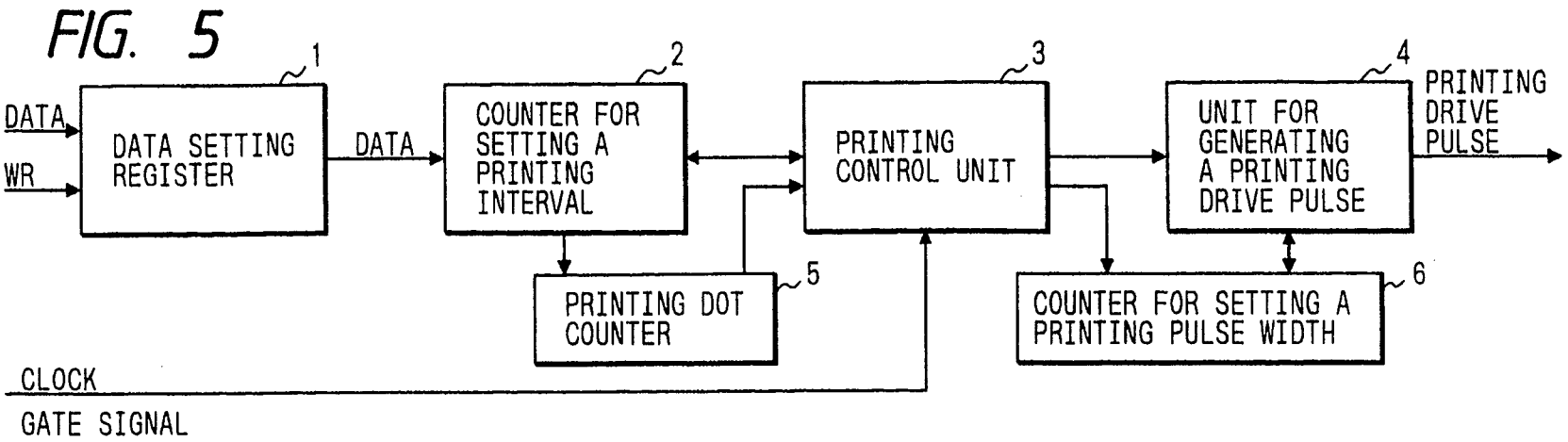
FIG. 5
DATA
WR
1
DATA SETTING REGISTER
DATA
2
COUNTER FOR SETTING A PRINTING INTERVAL
3
PRINTING CONTROL UNIT
4
UNIT FOR GENERATING A PRINTING DRIVE PULSE
PRINTING DRIVE PULSE
5
PRINTING DOT COUNTER
6
COUNTER FOR SETTING A PRINTING PULSE WIDTH
CLOCK
GATE SIGNAL

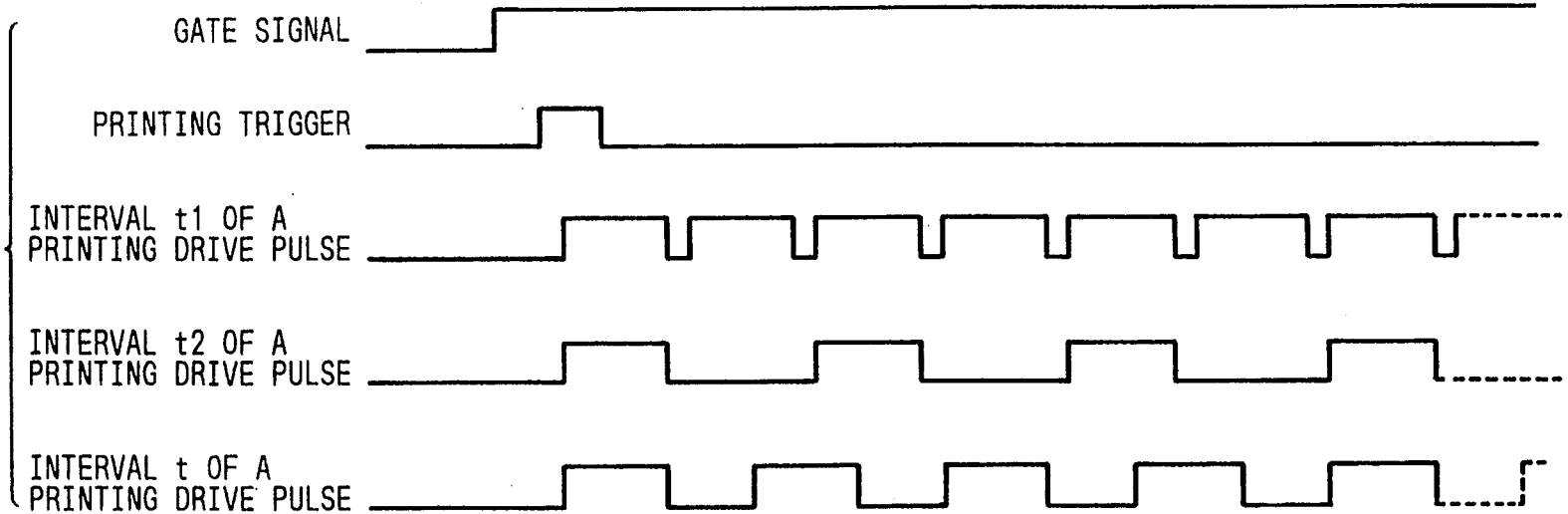
FIG. 6
GATE SIGNAL
PRINTING TRIGGER
INTERVAL t1 OF A PRINTING DRIVE PULSE
INTERVAL t2 OF A PRINTING DRIVE PULSE
INTERVAL t OF A PRINTING DRIVE PULSE

INK JET PRINTER WITH A DEVICE FOR DETERMINING A PRINTING INTERVAL

BACKGROUND OF THE INVENTION

The present invention relates to an ink jet printer, in which a printing head arranging a plurality of nozzles in a line is mounted on the carriage moved relative to the recording medium, in such a manner that the printing head is inclined by a predetermined angle with respect to the printing direction, and those nozzles are operated successively at predetermined time intervals to jet ink, thereby to print in the direction of an arrangement of the nozzles and by a length of the arrangement of the nozzles, i.e., one printing line. More particularly, the present invention relates to the ink jet printer which is allowed to correct a shift in position while printing (hereinafter referred to as "a printing shift", when applicable), which is due to the mounting angle error generated when the printing head is mounted on the carriage.

Japanese Patent Application (OPI) No. 138953/1982 (the term "OPI" as used herein means an "unexamined published application") discloses a multi-ink jet printer in which a plurality of nozzles arranged in a line are mounted on the carriage moved relative to the recording medium in such a manner that the nozzles are inclined by a predetermined angle with respect to the printing direction. More specifically, the printing head of the ink jet printer has a plurality of nozzles set in such a manner that the nozzles are arranged in a line and inclined by a predetermined angle $\theta°$ with respect to the printing direction as shown in the FIG. 3(*a*), and is mounted on the carriage which is moved relative to the recording medium. Each of the nozzles is operated successively at a predetermined time interval t (sec) one by one, thereby to jet ink, and print in the direction of the arrangement of the nozzles and by a length thereof.

On the other hand, in order to correct the printing shift which occurs at a printing boundary between adjacent scanning lines, Japanese Patent Application (OPI) No's 109657/1987 and 243374/1990 disclose a method in which a test printing operation is carried out several times by moving the carriage both in "go" and "return" modes, and then an optimum printing position is determined by correcting the printing shift in each of the two modes.

However, in the case that a high-resolution printing head or a printing head having a large number of nozzles is used to obtain a high quality image, it cannot disregard a mounting angle error generated when the printing head is mounted on the carriage, so that there is a problem that the printed record is inclined without being printed vertical to the movement direction of the carriage.

The inclination of the printed record, which is due to the mounting angle error of the printing head, cannot be corrected by the aforementioned methods. Furthermore, with the ink jet printer, a printing shift occurs at the printing boundary. Therefore, the resultant record is greatly deteriorated in image quality. In the test printing method as described above, the test printing operation is carried out several times in a reciprocation mode until the printing shift is eliminated. If the printing shift is greatly generated, then the test printing operation must be carried out so many times. On the other hand, with an ink jet printer in which the carriage is driven at two different speeds such as a normal speed and a higher speed, the printing position determined by the test printing method cannot be applied as it is. Particularly, since the printing position is determined without taking the variation of the carriage driving speed into account, there is a problem that the printing shift is generated at the printing boundary.

SUMMARY OF THE INVENTION

An object of the present invention is to provide an ink jet printer which can readily correct a printing shift which is due to a mounting angle error generated when a printing head is mounted on a carriage.

To accomplish the above object, the present invention provides the ink jet printer including the carriage adapted to move relative to a recording medium, the printing head mounted on the carriage in such a manner that the printing head is inclined by a predetermined angle with respect to a printing direction, a plurality of nozzles arranged in a line on the printing head, first device for jetting ink from the nozzles and printing in a direction of an arrangement of the nozzles by a length thereof by driving each of the nozzles at a predetermined time interval, second device for determining a printing interval between adjacent nozzles in accordance with a printing speed of the printing head and a mounting angle defined thereby.

With the ink jet printer, the second device includes a head control unit for driving the printing head in an angle error correcting mode for an angle correction thereof, and in the angle error correcting mode, an adjusting pattern, in which a plurality of vertical ruled lines are arranged at predetermined intervals, is printed while a nozzle printing interval is varied, and the printing head scans by at least twice the length of the arrangement of the nozzle, i.e., two printing lines, to detect a coincident point at a printing boundary, thereby to determine a printing interval between the adjacent nozzles.

With the ink jet printer, the second device can operate to calculate the following equation to determine an optimum printing interval $t_{CH}$ between the adjacent nozzles for a higher printing speed n times than a normal printing speed:

$$t_{CH}=t_c/n$$

where $t_c$ is the optimum printing interval between adjacent nozzles for the normal printing speed.

With the ink jet printer, the printing interval t (sec) between the adjacent nozzles is set within a domain defined by the following expression:

$$p \leqq t \leqq T/(N/n)$$

where N is a total number of the nozzles, n is a number of the nozzles driven simultaneously, T is a printing interval until one of said nozzles is driven again (sec), and p is a drive pulse width (sec).

Further, with the ink jet printer, the predetermined angle $\theta°$ formed by the head and printing direction is set within a domain defined by the following expression:

$$\tan^{-1}\{(S\times(N/n-1)\times p)/L\} \leqq \theta° \leqq \tan^{-1}\{(S\times(N/n-1)\times t)/L\}$$

where S is a carriage speed (m/sec), N is the total number of the nozzles, n is the number of the nozzles driven simultaneously, p is the drive pulse width (sec), t is the printing interval between the adjacent nozzles (sec), T is the printing interval until one of said nozzles is driven again (sec), and L is a total of intervals in distance between all the nozzles (m).

According to the present invention, the printing interval between the adjacent nozzles can be set selectively, whereby an image can be printed which is suitably inclined with respect to the direction perpendicular to the direction of movement of the carriage. That is, the printing interval between the adjacent nozzles is set optimum according to the angle defined by the printing head and printing direction, which eliminates the difficulty that a printing shift is caused at the printing boundary by the mounting error of the printing head. Furthermore, when the carriage printing speed is changed from the normal speed to the higher speed, the optimum printing interval between the adjacent nozzles for the normal speed is corrected to obtain the optimum printing interval between adjacent nozzles for the higher speed.

The nature, principle, and utility of the present invention will be more clearly understood from the following detailed description of the present invention when read in conjunction with the accompanying drawings.

BRIEF DESCRIPTION OF THE DRAWINGS

In the accompanying drawings:

FIG. 2(*b*) is an explanatory diagram for a description of the fact that, when the printing head is operated as shown in FIG. 2(*a*), the printed vertical ruled lines is inclined by an angle $\theta_t°$, and a printing shift d occurs at the printing boundary;

FIG. 3(*b*) is an explanatory diagram for a description of the fact that, when the printing head is operated as shown in FIG. 3(*a*), no printing shift occurs at the printing boundary;

FIG. 4(*b*) is an explanatory diagram illustrating the inclination $\theta_{t2}°$ of the vertical ruled lines which is caused when the printing head mounted perpendicular to the carriage scanning direction is operated with a maximum printing interval $t_2$ (sec) between the adjacent nozzles;

FIG. 4(*c*) is an explanatory diagram illustrating the printing head the mounting angle $\theta_t°$ of which is set to $(\theta_{t1}°+\theta_{t2}°)/2$;

FIG. 5 is a block diagram illustrating the arrangement of a printing interval control unit for controlling the printing interval between the adjacent nozzles;

FIG. 6 is a time chart illustrating an output timing of printing drive pulses generated from the printing interval control unit;

FIG. 7(*b*) is an explanatory diagram illustrating the fact, when the printing head is mounted as shown in FIG. 7(*a*), the printed vertical lines are inclined by an angle $\theta_e°$;

FIG. 11 is a sequential flow chart illustrating the operation of the operating system when a power switch is turned on.

DETAILED DESCRIPTION OF THE PREFERRED EMBODIMENTS

Figure 1:
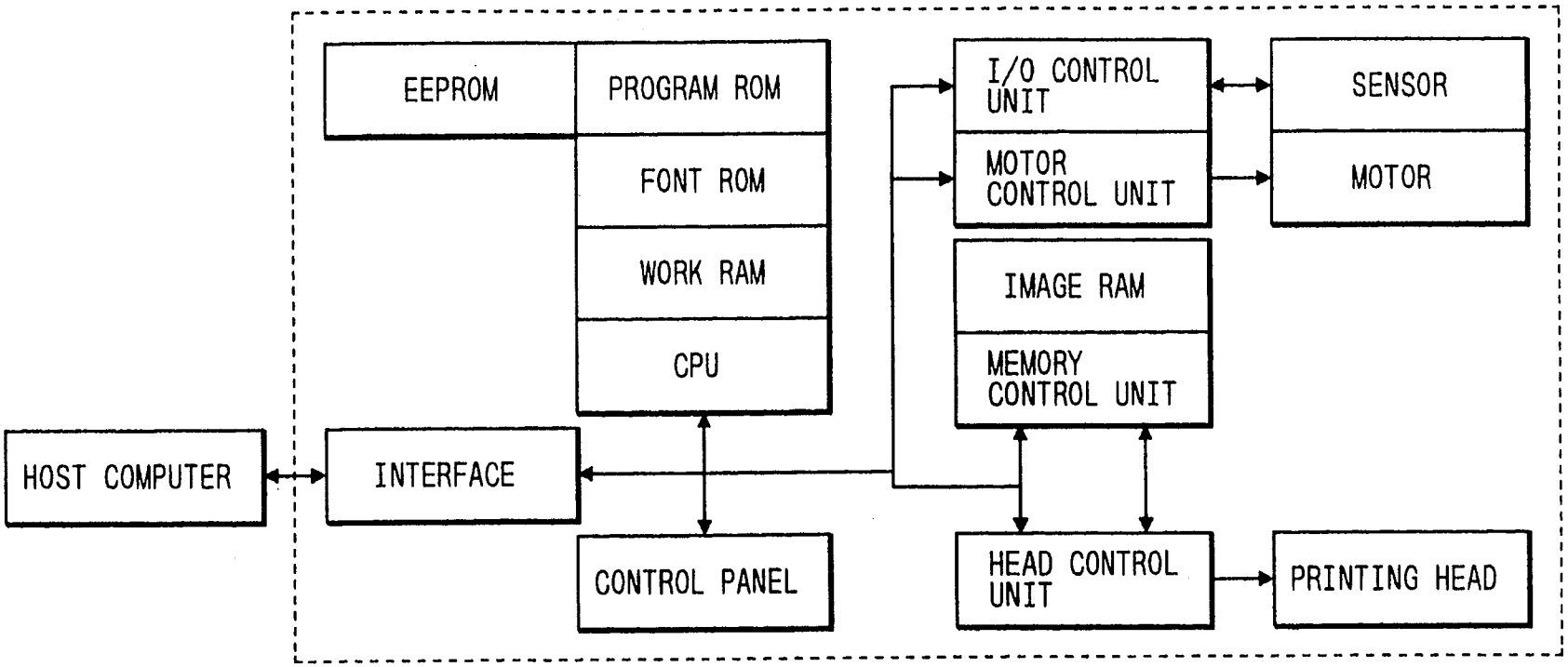
FIG. 1 is a block diagram illustrating a whole arrangement of an operating system with an ink jet printer according to the present invention.
Figure 4A:
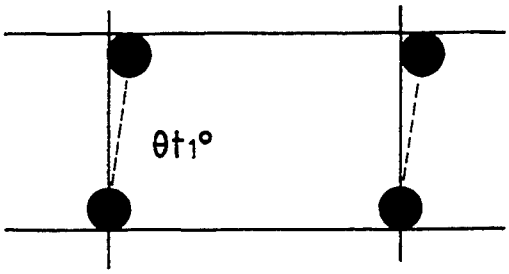
FIG. 4(*a*) is an explanatory diagram illustrating the inclination $\theta_{t1}°$ of vertical ruled lines which is caused when the printing head mounted perpendicular to the carriage scanning direction is operated with a minimum printing interval $t_1$ (sec) between the adjacent nozzles.
Figure 4B:
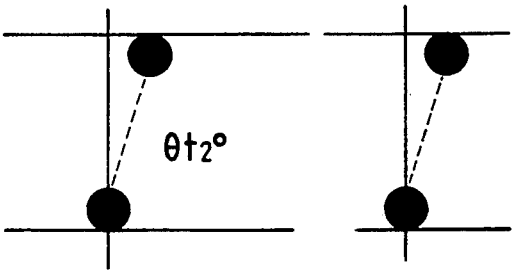
Figure 4C:
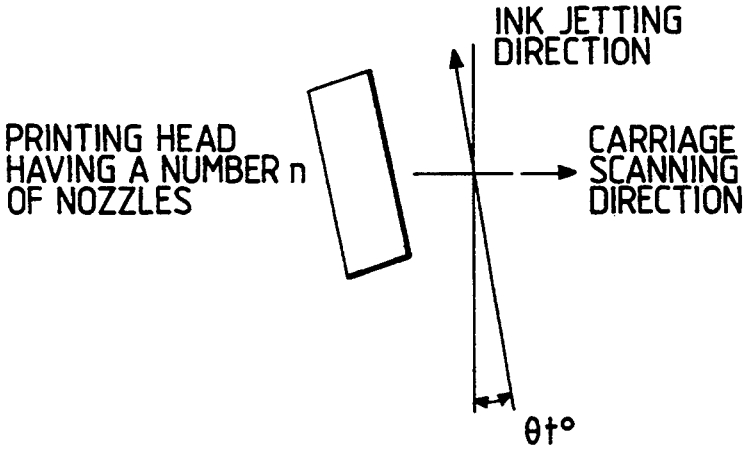

An ink jet printer according to the present invention is provided with an operating system as shown in FIG. 1. A head control unit as shown in FIG. 1 is provided with a printing interval control unit as shown in FIG. 5. The printing interval control unit provides a counter 2 for setting a printing interval and a printing control unit 3 which generates a variety of timing pulse signals in response to an output signal of the counter 2 for setting the printing interval. The counter 2 is constructed for the purpose of selectively setting a printing interval between adjacent nozzles according to the present invention. When the printing head mounted perpendicular to the scanning direction is driven at a minimum printing interval $t_1$ (sec) between the adjacent nozzles to form a vertical ruled line, then the inclination of the vertical ruled line with respect to the vertical direction is $\theta_{t1}°$ as shown in FIG. 4(*a*). When the printing head is driven at a maximum printing interval $t_2$ (sec) between the adjacent nozzles, the inclination is $\theta_{t2}°$ as shown in FIG. 4(*b*). Therefore, an operation of the ink jet printer will be described in the case in which the printing head is mounted on the carriage in such a manner that the printing head is inclined by a predetermined angle $\theta_t°=(\theta_{t1}°+\theta_{t2}°)/2$ in opposition to the printing angles shown in FIGS. 4(*a*) and (*b*).

In this case, the initial value of the printing interval between the adjacent nozzles is stored, as $t=(t_1+t_2)/2$, in a program ROM (as shown in FIG. 1). When, with the printing head mounted in the above-described manner, the power switch is turned on, an optimum printing interval t (sec) between the adjacent nozzles with respect to the inclination $\theta_t°$ of the printing head is loaded from the program ROM down into a writable and nonvolatile memory, namely, an EEPROM (electrically erasable programmable read-only memory). The EEPROM is constructed so as to employ as a memory device according to the present invention.

When a printing operation starts, a CPU (central processing unit) fetches data of the printing interval t (sec) between the adjacent nozzles from the EEPROM, and then the data is stored in a data setting register 1 as shown in FIG. 5. When a printing trigger signal is received, the printing control unit 3 outputs a signal to set the data stored by the data setting register 1 into the counter 2 for setting the printing interval. This signal is further used to set a drive pulse width value into a counter 6 for setting a printing pulse width. On the other hand, the printing control unit 3 outputs a count clock signal into the counters 2 and 6, respectively, while a unit 4 for generating a printing drive pulse outputs a pulse which is set to "H (high)" level, so that a current is applied to the printing head heater. When the counter 6 for setting the printing pulse width counts a predetermined value, the counter 6 applies a termination signal to the unit 4 for generating the printing drive pulse, so that the printing drive pulse is set to "L (low)" level, and then the current is suspended from applying to the printing head heater.

When the counter 2 for setting the printing interval counts a predetermined value, the counter 2 applies one count clock signal to a printing dot counter 5, so that the present number of printing dots is controlled. In addition, the counter 2 also applies a termination signal to the printing control unit 3. In response to the termination signal, the printing control unit 3 starts the next printing operation. The above-described operations are repeatedly carried out. When the printing dot counter 5 counts a value corresponding to the number of nozzles, the printing control unit 3 is inhibited from issuing the trigger signal for starting the printing operation. Thus, all the nozzles are driven through the above-described operations. The printing drive pulses are generated in correspondence to the number of nozzles driven at intervals of t (sec) as shown in FIG. 6, so that ink is jetted to form an image.

Figure 7A:
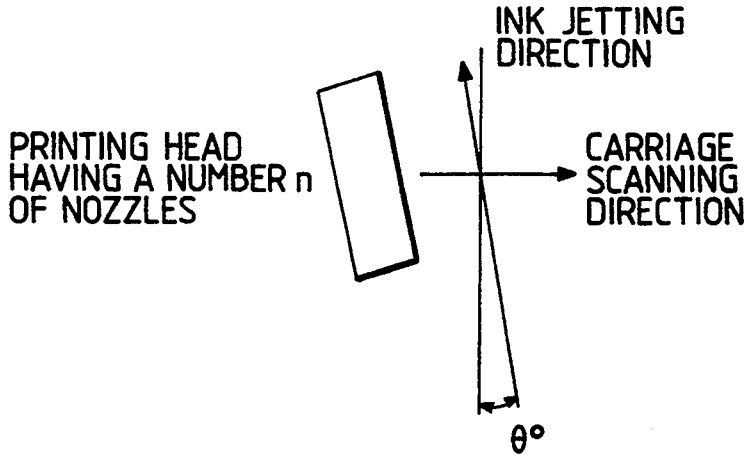
FIG. 7(*a*) is an explanatory diagram illustrating the printing head the mounting angle of which is $\theta°$.
Figure 7B:
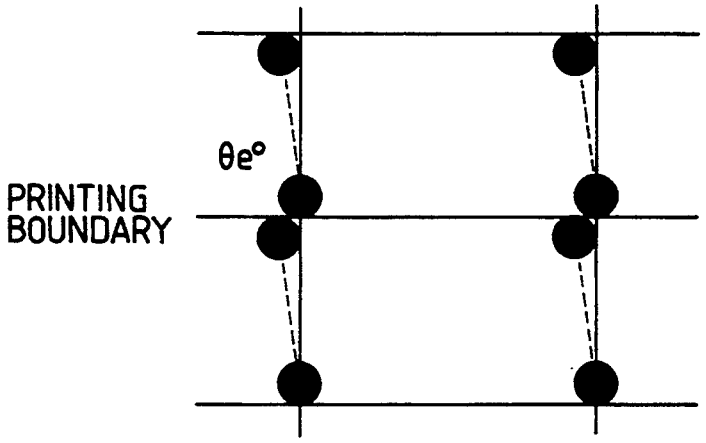

In this case, if the angle defined by the printing head is $\theta_t°$, then the high quality image can be obtained with no printing shift at the printing boundary. However, when the angle defined by the printing head, as shown in FIG. 7(*a*), is generated as much as an angle error $\theta_e°$ because of mounting and manufacturing dispersions of the printing head, that is, when the total angle of the inclination of the printing head is $\theta°=(\theta_t°+\theta_e°)$, the print images in one scanning line are inclined by the angle error $\theta_e°$ as shown in FIG. 7(*b*), and further the print image is displaced at the printing boundary.

Figure 8:
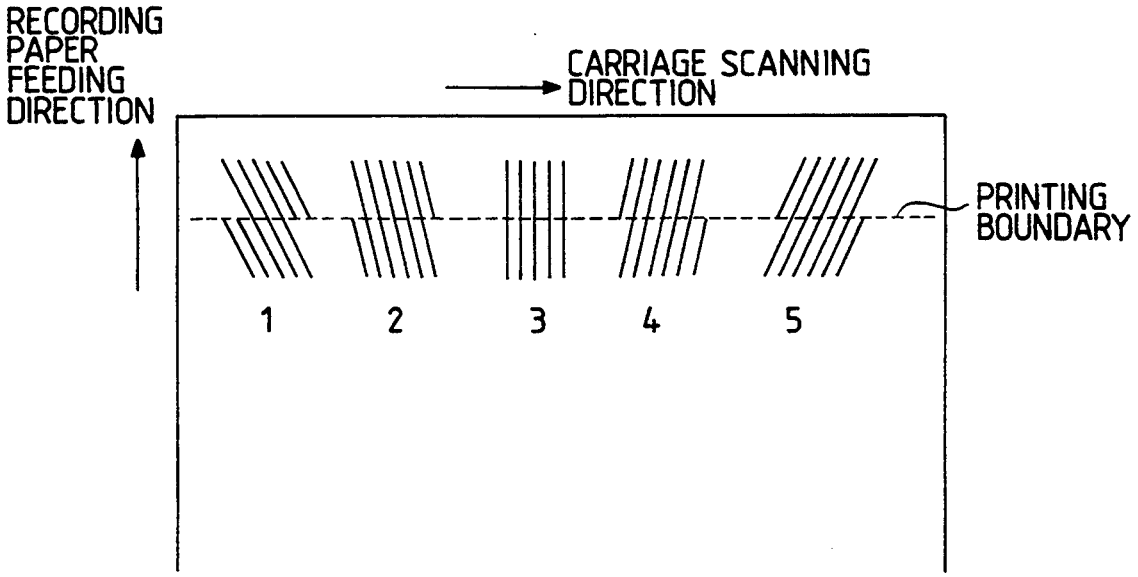
FIG. 8 is an explanatory diagram illustrating print samples which are performed in an angle error correcting mode.

In order to correct the printing shift because of the angle error, an angle error correcting mode is performed. In the angle error correcting mode, as shown in FIG. 8, vertical ruled lines are printed as an adjusting pattern. In the case shown in FIG. 8, the vertical ruled lines are printed five times at intervals of 32 dots. During the printing operation, a printing interval between the adjacent nozzles is constant.

The printing interval between the adjacent nozzles is increased by one step. After the carriage is moved to a certain distance, the vertical ruled lines are printed five times at the intervals of 32 dots. During the printing of one scanning line, the printing operation is repeatedly carried out as long as the printing interval between the adjacent nozzles can be increased stepwise in the above-described manner. In the case of FIG. 8, since the printing interval between the adjacent nozzles can be increased to five steps, five blocks of the vertical ruled lines are printed at the intervals of 32 dots.

Figure 10:
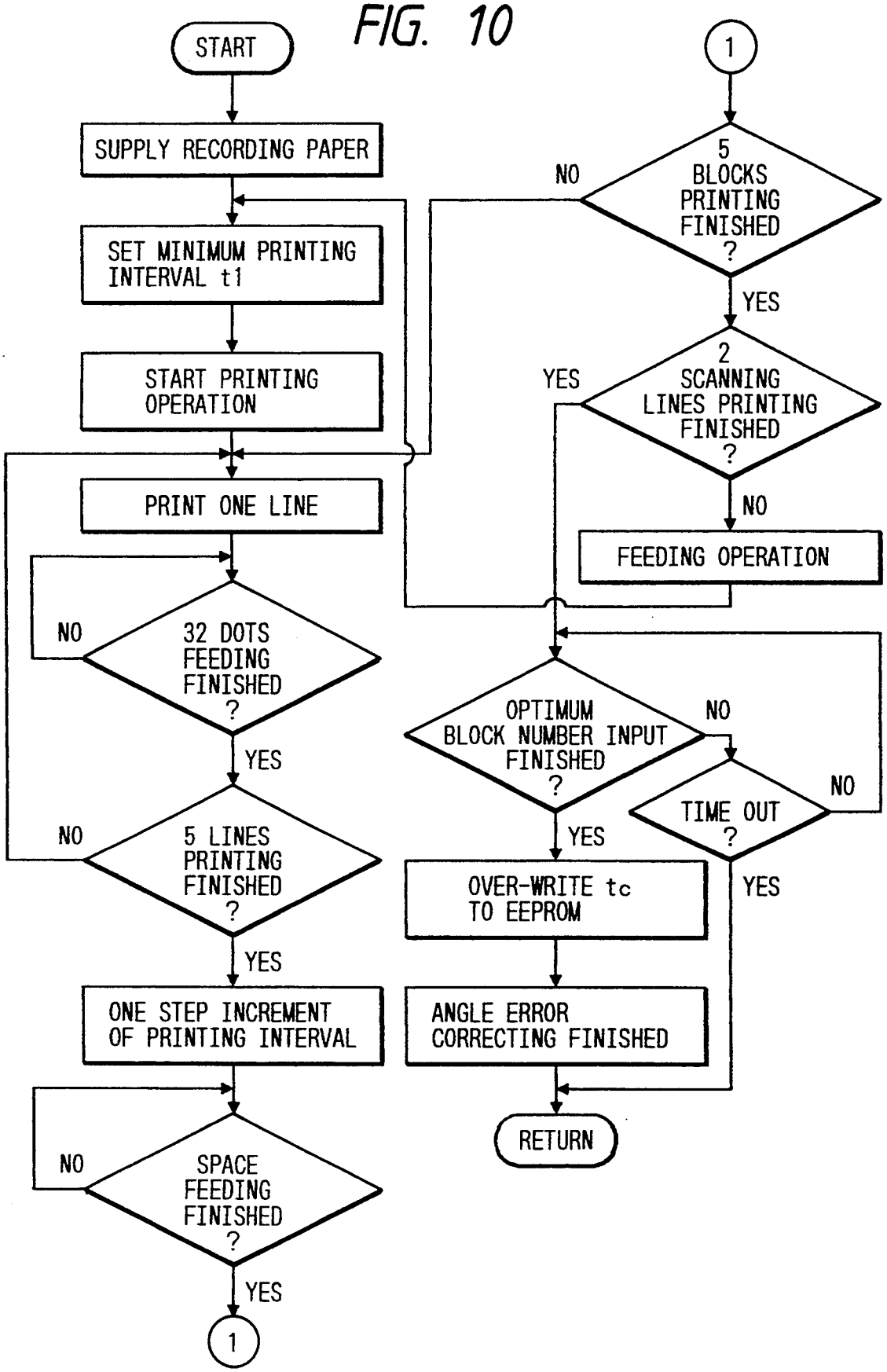
FIG. 10 is a flow chart illustrating the operation of the operating system in the angle error correcting mode.

When the printing of the first scanning line is accomplished, the printing sheet is fed as much as a length of an arrangement of the nozzles so that the printing of the second scanning line is started. For the second scanning line, the printing operation is carried out completely in the same manner as in the printing operation for the first scanning line. During the scanning of those two scanning lines, a block number of the vertical ruled lines having no printing shift at the printing boundary, is inputted through a control panel (as shown in FIG. 1), so that the optimum printing interval between the adjacent nozzles can be selected with ease. The above-described angle correcting operations are indicated in a flow chart of FIG. 10.

In the case shown in FIG. 8, the third block of the vertical ruled lines has no printing shift. Therefore, the number "3" is inputted through the control panel (as shown in FIG. 1), or a predetermined switch is pushed down three times. That is, in this case, the printing interval between the adjacent nozzles which is set third is an optimum value.

As is described above, the optimum printing interval between the adjacent nozzles can be determined by performing the printing operation for the two scanning lines. That is, the correcting operation can be achieved in a short time. In addition, since the correcting operation does not need a large printing space, it can be included in a test printing mode performed generally. it is not necessary to use a recording sheet only for correction. Thus, through the above-described operations it can determine an optimum corrected printing interval $t_c$ (sec) between the adjacent nozzles with ease.

Figure 9:
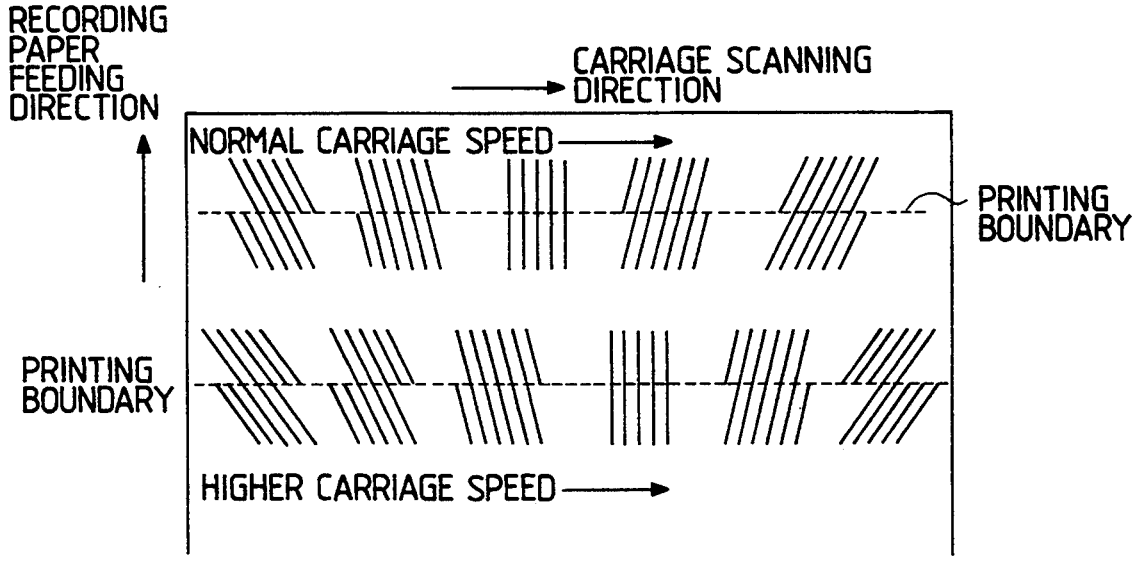
FIG. 9 is also an explanatory diagram illustrating print samples which are performed in the angle error correcting mode, in which the upper print samples are printed when the carriage is moved at a normal speed, and the lower print samples are printed when the carriage is moved at a higher speed.

However, in the case that there are two printing operations different in printing speed; a first printing operation performed with a normal carriage scanning speed, and a second printing operation performed with a higher carriage scanning speed, the above-described corrected printing interval $t_c$ (sec) cannot be used for the second printing operation. In this case, as shown in FIG. 9, the above-described correcting operations are carried out with the normal carriage scanning speed and then with the higher carriage scanning speed, to determine the optimum corrected printing intervals $t_c$ (sec) for the normal speed and $t_{CH}$ (sec) for the higher speed, respectively. As is apparent from FIG. 9, the correcting operation needs a printing space corresponding to five scanning lines. Therefore, the correcting operation is not suitable for the case that it is not desirable to use a large printing space, and for the case that it is required to simplify the correcting operation.

Figure 2A:
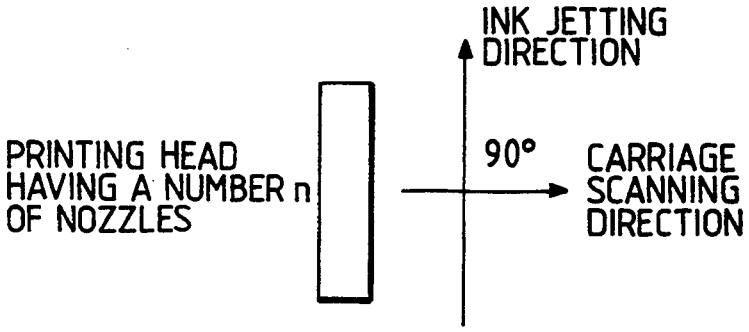
FIG. 2(a) PRIOR ART
FIG. 2(*a*) is an explanatory diagram for a description of a printing head which is set perpendicular to a carriage scanning direction, and operated with a printing interval t (sec) between adjacent nozzles.
Figure 2B:
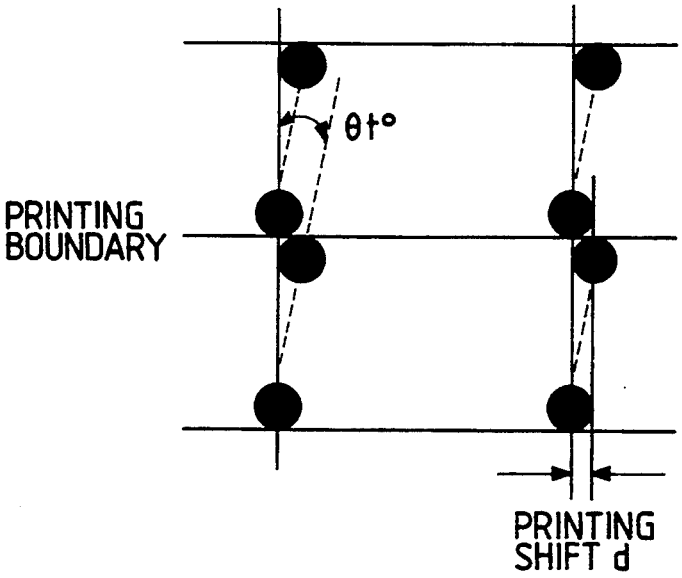
FIG. 2(b) PRIOR ART
Figure 3A:
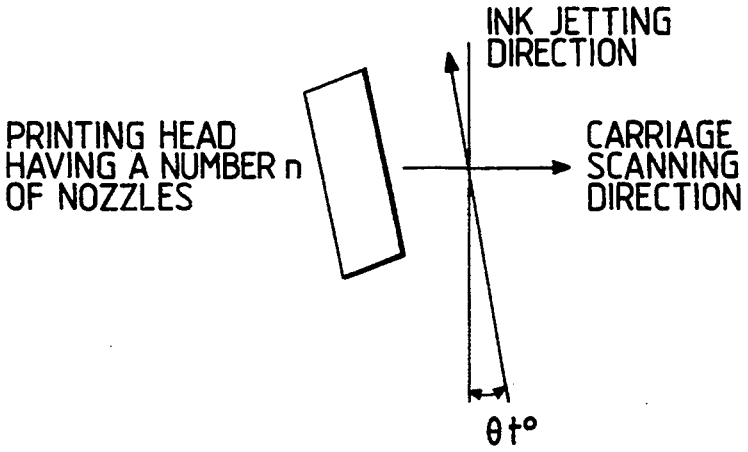
FIG. 3(a) PRIOR ART
FIG. 3(*a*) is an explanatory diagram for a description of the printing head which is mounted on the carriage in such a manner that the printing head is inclined by a predetermined angle $\theta_t°$ with respect to a direction perpendicular to the carriage scanning direction, and is operated with the printing interval t (sec) between the adjacent nozzles.
Figure 3B:
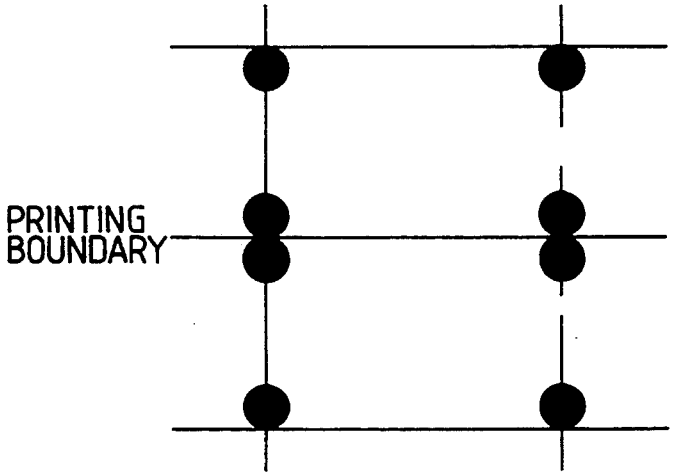
FIG. 3(b) PRIOR ART

In the above-described embodiment of the present invention, although the correcting operation is achieved by using only two scanning lines, the corrected printing interval $t_c$ (sec) obtained by the correcting operation can be utilized to calculate the optimum corrected printing interval $t_{CH}$ (sec) between the adjacent nozzles during the printing operation at the higher speed. In general, in the case that a printing operation is carried out with a printing head mounted perpendicular to the carriage scanning direction, a printing angle $\theta_t°$ with respect to the vertical direction, as shown in FIG. 2, can be represented by the following equation (1):

$$\theta_t° = \tan^{-1}\{(S\times(N/n-1)\times t)/L\} \quad (1)$$

where S is the carriage scanning speed (m/sec), N is a total number of nozzles, n is a number of the nozzles driven simultaneously, t is the printing interval between the adjacent nozzles (sec), and L is a total of intervals in distance between all the nozzles (m).

Equation (1) can be rewritten as follows:

$$\theta_t^\circ = \tan^{-1}\{K \times (S \times t)\} \quad (2)$$

where $K = (N/n - 1)/L$ (being a constant).

Equation (2) reveals the following fact: In the case that the carriage scanning speed becomes n times as high as an normal speed, if the printing interval between the adjacent nozzles becomes (1/n) times, then the printing angle is constant at all times, and the constant value is $\theta_t^\circ$. Therefore, when the carriage scanning speed is n times as high as the normal speed during the printing operation, 1/n times the corrected printing interval $t_c$ (sec) obtained in the angle error correcting mode is the optimum corrected printing interval $t_{CH}$ (sec) between the adjacent nozzles for the higher printing speed. That is, the optimum printing interval $t_{CH}$ (sec) between the adjacent nozzles for the higher printing speed can be calculated by performing the following equation for the printing interval $t_c$ (sec) which is obtained through the above-described procedure:

$$t_{CH} = t_c/n \quad (3)$$

Moreover, the optimum printing interval $t_{CH}$ (sec) between the adjacent nozzles for the higher printing speed can be selected from the most approximate value of several printing intervals previously set into the program ROM or the like in comparison with the value calculated by the equation (3).

When the $t_c$ (sec) is determined in the angle error correcting mode as described above, the angle error printing mode finishes, and then the normal printing operation starts again. In the system shown in FIG. 1, the corrected printing interval $t_c$ (sec) is over-written to the address of the EEPROM where the printing interval t (sec) between the adjacent nozzles is stored until the start of the angle error correcting mode. Thereafter, the CPU fetches the corrected printing interval $t_c$ (sec) between the adjacent nozzles. The CPU is constructed for determining the optimum printing interval between the adjacent nozzles according to the present invention.

Figure 11:
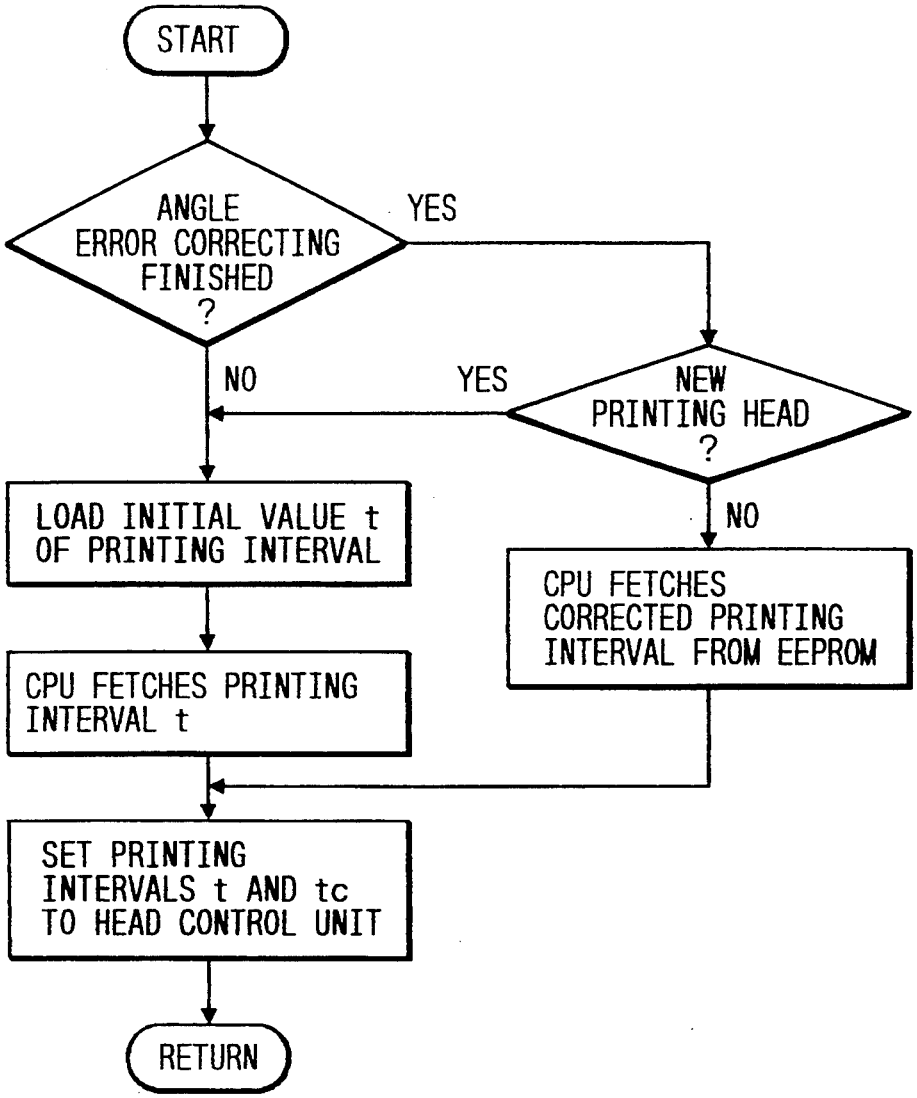

After the power switch is turned on, the system operates as shown in a flow chart of FIG. 11. The operation that the optimum printing interval t (sec) between the adjacent nozzles for the inclination of $\theta_t^\circ$ of the nozzles of the printing head is loaded down into the EEPROM is inhibited after the angle error correcting mode starts. When a new printing head is mounted on the carriage, the operation of loading the printing interval t (sec) between the adjacent nozzles down into the EEPROM is permitted. As long as the system is not in the angle error correcting mode, the CPU fetches the printing interval t (sec) between the adjacent nozzles, and performs the above-described operations.

As is described above, with the ink jet printer according to the present invention, the printing shift, which is due to the mounting angle error generated when the printing head is mounted on the carriage, can be eliminated by readily setting the optimum printing interval between the adjacent nozzles in accordance with the mounting angle defined by the printing head. Therefore, the ink jet printer dispenses with a mechanical system for finely adjusting the mounting of the printing head, that is, the head cartridge mounting mechanism can be simplified as much. Further, the ink jet printer according to the present invention can print satisfactory images at all times.

While there has been described in connection with the preferred embodiments of the present invention, it will be obvious to those skilled in the art that various changes and modifications may be made therein without departing from the present invention.

What is claimed is:

1. An ink jet printer comprising:

a carriage adapted to move relative to a recording medium;

a printing head mounted on said carriage and inclined at a predetermined angle with respect to a printing direction;

a plurality of nozzles arranged in a line on said printing head;

first means for jetting ink from said nozzles and printing in a direction of the arrangement of said nozzles by a length by driving each of said nozzles at a predetermined time interval; and second means for determining a printing interval between adjacent nozzles in accordance with a printing speed of said printing head and said mounting angle defined by said printing head, wherein said second means comprises a CPU, a ROM storing an initial value of said printing interval for said CPU, an EEPROM serving as a writable and non-volatile memory device for said CPU, and a head control unit driving said printing head, said second means determining the printing interval between adjacent nozzles for a normal printing speed by performing at least two angle error correcting operations for correcting an angle error of said mounting angle, said angle error correcting operations including operations to print an adjusting pattern arranged with a plurality of vertical ruled lines at a constant printing interval, to print said adjusting pattern while said printing interval between said adjacent nozzles is increased, and then to feed said recording medium by a length of the arrangement of said nozzles, and further to determine said printing interval between said adjacent nozzles for said normal printing speed by detecting vertical ruled lines having no printing shift at a printing boundary.

2. The ink jet printer of claim 1, wherein said printing interval between said adjacent nozzles for said normal printing speed is employed for calculating an equation to determine a printing interval between said adjacent nozzles for a printing speed n times as high as said normal printing speed:

$$t_{CH} = t_c/n$$

where $t_{CH}$ is said printing interval between said adjacent nozzles for the printing speed n times as high as said normal printing speed, and $t_c$ is said printing interval between said adjacent nozzles for said normal printing speed.

3. An ink jet printer comprising:

a carriage adapted to move relative to a recording medium;

a printing head mounted on said carriage and inclined at a predetermined angle with respect to a printing direction;

a plurality of nozzles arranged in a line on said printing head;

first means for jetting ink from said nozzles and printing in a direction of the arrangement of said nozzles by a length by driving each of said nozzles at a predetermined time interval; and second means for determining a printing interval between adjacent nozzles in accordance with a printing speed of said printing head and said mounting angle defined by said printing head, wherein said printing interval between said adjacent nozzles is set within a domain defined by an expression:

$$p \leqq t \leqq T/(N/n)$$

where t is said printing interval between said adjacent nozzles (sec), N is a total number of said nozzles, n is a number of said nozzles driven simultaneously, T is a printing interval until one of said nozzles is driven again (sec), and p is a drive pulse width (sec).

4. An ink jet printer comprising:

a carriage adapted to move relative to a recording medium;

a printing head mounted on said carriage and inclined at a predetermined angle with respect to a printing direction;

a plurality of nozzles arranged in a line on said printing head;

first means for jetting ink from said nozzles and printing in a direction of the arrangement of said nozzles by driving each of said nozzles at a predetermined time interval; and second means for determining a printing interval between adjacent nozzles in accordance with a printing speed of said printing head and a mounting angle defined by said printing head, wherein said predetermined angle formed by said printing head and printing direction is set within a domain defined by an expression:

$$\tan^{-1}\{(S\times(N/n-1)\times p)/L\} \leqq \theta^\circ \leqq \tan^{-1}\{(S\times(N/n-1)\times t)/L\}$$

where $\theta^\circ$ is said predetermined angle formed by said printing head and said printing direction, S is a carriage speed (m/sec), N is a total number of said nozzles, n is a number of said nozzles driven simultaneously, p is a drive pulse width (sec), t is said printing interval between said adjacent nozzles (sec), T is a printing interval until one of said nozzles is driven again (sec), and L is a total of intervals in distance between all of said nozzles (m).

5. The ink jet printer of claim 1, wherein said head control unit comprises a printing interval control unit including a first counter for setting said printing interval and providing a corresponding output signal, a printing control unit for generating a variety of timing pulse signals in response to said first counter output signal, a printing dot counter for controlling a number of printing dots, a second counter for setting a printing pulse width in accordance with one of said variety of timing pulse signals, and a drive unit for generating a printing drive pulse in response to one of said variety of timing pulse signals from said printing control unit.

6. A method for correcting an angle error of a printing head inclined and mounted on a carriage at a predetermined angle comprising the steps of:

(a) setting an initial printing interval between adjacent nozzles of said inclined printing head;

(b) successively operating said adjacent nozzles at said initial printing interval to print a first sample of an adjusting pattern of a plurality of ruled lines on a recording medium;

(c) printing first samples of said adjusting pattern predetermined times while increasing said printing interval;

(d) advancing said recording medium by a length corresponding to an arrangement of said nozzles;

(e) repeating said steps (b), (c), and (d) for second samples of said adjusting pattern to create a printing boundary between said first and second samples;

(f) detecting an arrangement of said ruled lines having no printing shift and no angular displacement at said printing boundary; and (g) determining the printing interval between said adjacent nozzles for said detected arrangement to correct said angle error.

7. The method of claim 6, further comprising the step of calculating a printing interval between said adjacent nozzles in accordance with a printing speed of said printing head by utilizing said printing interval determined in said step (g).

8. An ink jet printer having a carriage adapted to move relative to a recording medium, a printing head mounted on said carriage and inclined at a predetermined printing head angle with respect to a printing direction, and a plurality of consecutive nozzles arranged in a line on said printing head, said consecutive nozzles being serially energized based on printing data, comprising:

first means for serially jetting ink from said consecutive nozzles to print at least one line for a plurality of times, said first means setting, for said plurality of times, different printing intervals at which said consecutive nozzles are serially energized;

second means for receiving a selection among said different printing intervals set by said first means; and third means for storing a printing interval defined by the selection received by said second means, the printing interval stored by said third means being used for subsequent printing operations.

* * * * *

UNITED STATES PATENT AND TRADEMARK OFFICE

CERTIFICATE OF CORRECTION

PATENT NO. : 5,442,383

DATED : August 15, 1995

INVENTOR(S) : Takeshi FUSE

It is certified that error appears in the above-indentified patent and that said Letters Patent is hereby corrected as shown below:

Claim 3, column 8, line 65, delete "by a length".

Signed and Sealed this

Fourth Day of June, 1996

*Attest:*

*Attesting Officer*

BRUCE LEHMAN

*Commissioner of Patents and Trademarks*